United States Patent [19]

Kern et al.

[11] Patent Number: 4,688,723

[45] Date of Patent: Aug. 25, 1987

[54] ELECTROMAGNETICALLY ACTUATABLE FUEL-INJECTION VALVE

[75] Inventors: Eckhart Kern; Reiner Weingärtner, both of Hofheim; Gerhard Ruschek, Hattersheim; Arnold Mann, Bieber; Horst Schlick, Schwalbach, all of Fed. Rep. of Germany

[73] Assignee: VDO Adolf Schindling AG, Frankfurt am Main, Fed. Rep. of Germany

[21] Appl. No.: 821,379

[22] Filed: Jan. 22, 1986

[30] Foreign Application Priority Data

Jan. 23, 1985 [DE] Fed. Rep. of Germany ..... 3502086

[51] Int. Cl.[4] ..... A62C 31/02; F02M 61/00; B05B 1/30

[52] U.S. Cl. ..... 239/391; 239/533.12; 239/585

[58] Field of Search ..... 239/390, 391, 500, 518, 239/533.12, 585

[56] References Cited

U.S. PATENT DOCUMENTS

| | | | |
|---|---|---|---|
| 2,619,378 | 11/1952 | Watkins | 239/390 |
| 2,860,780 | 11/1958 | Ziesche | 239/533.12 X |
| 4,266,729 | 5/1981 | Kulke et al. | 239/533.12 |
| 4,421,278 | 12/1983 | Kienzle | 239/533.12 |
| 4,452,396 | 6/1984 | Cataldo | 239/223 |

FOREIGN PATENT DOCUMENTS

| | | | |
|---|---|---|---|
| 894789 | 9/1953 | Fed. Rep. of Germany | 239/533.12 |
| 2528683 | 6/1974 | Fed. Rep. of Germany | 239/585 |

*Primary Examiner*—Andres Kashnikow
*Assistant Examiner*—Patrick N. Burkhart
*Attorney, Agent, or Firm*—Martin A. Farber

[57] ABSTRACT

In a fuel-injection valve, a holding member which bears a plug as atomizing and metering element is inserted in a valve bore. A replaceable diaphragm makes it possible to adjust the precise discharge quantity of the fuel-injection valve by replacement of said diaphragm.

4 Claims, 2 Drawing Figures

ELECTROMAGNETICALLY ACTUATABLE FUEL-INJECTION VALVE

FIELD AND BACKGROUND OF THE INVENTION

The present invention refers to an electromagnetically actuatable fuel-injection valve for injection systems of internal combustion engines, having a valve housing, a plug as metering element arranged in a valve bore of the valve housing, a soft-iron core which bears a stationary magnet winding and is arranged within the valve housing, and an armature which is coaxial to said core and opposite it, forming an air gap, the armature being firmly attached to a closure member which controls the discharge. Such injection valves are customary in modern injection engines and are therefore generally known.

The amount of fuel injected must be measured very accurately in internal combustion engines. This makes it necessary for each fuel-injection valve to be tested, after mounting, with respect to the quantity of fuel which it passes and, if necessary, for the discharge to be increased by further grinding either the hardened plug or the valve bore. This work is time consuming and therefore cost-intensive.

SUMMARY OF THE INVENTION

The object of the invention is to create a fuel-injection valve of the above type which has a highly accurate discharge and which can be manufactured in a simple and economical manner.

This object is achieved in accordance with the invention in the manner that the plug is seated within a replaceable diaphragm.

By this development of the fuel-injection valve in accordance with the invention, the additional work on the metering point which was previously necessary is done away with. The correct discharge quantity is obtained exclusively by simple replacement of the diaphragm.

The replacement of the diaphragm is particularly easy if the diaphragm is arranged between a removable stop on the valve housing which faces the injection side of the valve and a holding element which holds the plug and is inserted in the valve bore. With such an embodiment the diaphragm can be removed easily from the front of the valve housing as soon as the stop, which can be formed by a cap pushed thereover, has been removed.

The plug is preferably cylindrical in the region of the diaphragm so that the discharge quantity of the fuel-injection valve can be changed solely by changing the diameter of the diaphragm.

BRIEF DESCRIPTION OF THE DRAWING

The invention permits of numerous embodiments. One of them is shown diagramatically in the drawing and will be described below with reference to the drawing wherein.

DETAILED DESCRIPTION OF THE PREFERRED EMBODIMENT

Figure 1:
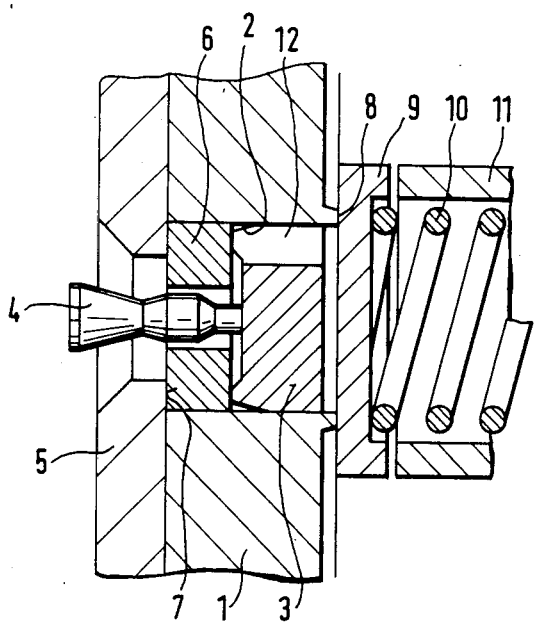
FIG. 1 is a longitudinal section of a portion of the value of the invention.

The drawing particularly FIG. 1, shows a longitudinal section through part of a valve housing 1 having a valve bore 2 within which a holding element 3 is fitted. The holding element 3 forms a unit with a plug 4 which represents an atomization and metering element for the fuel-injection valve. Between the holding member 3 and a removable front closure wall 5 a diaphragm 6 is positioned. The closure wall 5 forms a front stop 7 for the diaphragm.

Figure 2:
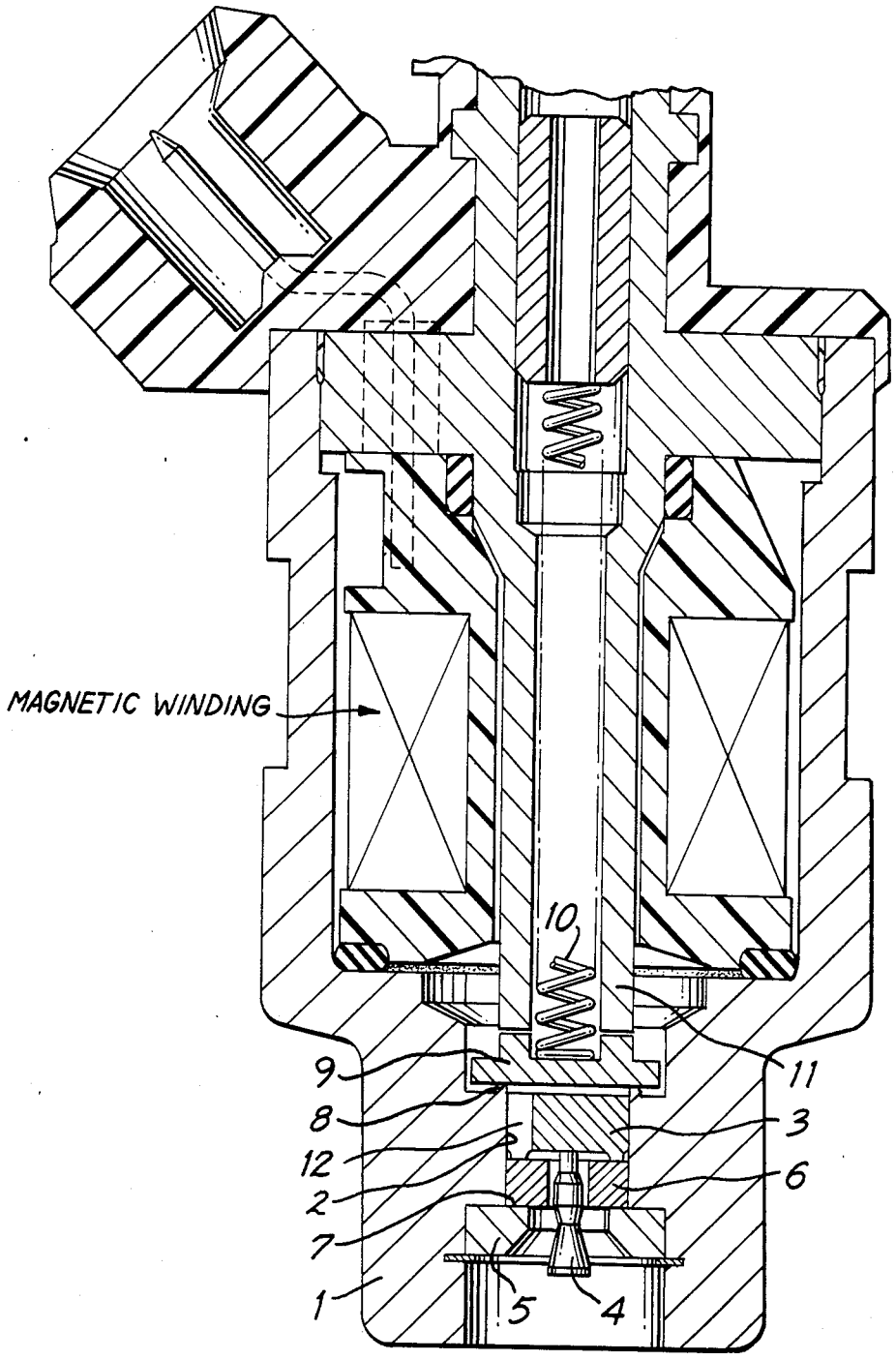
FIG. 2 is a longitudinal section of the valve of the invention showing both a fuel outlet portion as disclosed in FIG. 1 and a magnet winding and armature supporting the winding.

On the side facing away from the plug 4 the valve bore 2 terminates with a valve seat 8 against which a disk valve 9 is held by means of a compression spring 10. This disk valve 9 can move, against the force of the compression spring 10, against an armature 11 as soon as a magnetizing coil shown in FIG. 2, which surrounds the armature 11 is traversed by current. The fuel to be injected then flows between the valve seat 8 and the valve 9 thereupon through a passage 12 in the holding element 3 and then outwards between diaphragm 6 and plug 4.

The plug 4 can, of course, also form a unit with the disk valve 9. The only factor decisive for the invention is that the plug 4 be surrounded by a replaceable diaphragm.

What is claimed is:

1. An electromagnetically actuatable fuel-injection valve for injection systems of internal combustion engines, comprising:

a valve housing, and a plug serving as a metering element of the valve and located within a bore of said valve;

an armature configured for supporting a magnet winding in stationary relationship to the valve, said armature being located within said valve housing, said armature being disposed coaxially to said bore;

a removable stop located on the valve housing and facing away from the injection side of the valve, and a holding element disposed within the valve bore for holding said plug;

a closure element forming a gap with said armature, said gap allowing displacement of said closure element relative to said armature and to said holding element for controlling a discharge from the valve; and a diaphragm; and wherein said plug is seated within said diaphragm, and said diaphragm is located between said removable stop and said holding element to be replaceable.

2. An electromagnetically actuatable fuel-injection valve according to claim 1, wherein said plug is cylindrical in a region of said diaphragm.

3. An electromagnetically actuatable fuel-injection valve according to claim 2, wherein a passage for fuel is formed within said bore alongside a part of said holding element.

4. An electromagnetically actuatable fuel-injection valve according to claim 3, wherein said fuel passage extends between a part of said holding element and said diaphragm to envelope said plug.

* * * * *